US009240139B2

(12) United States Patent
Kim et al.

(10) Patent No.: US 9,240,139 B2
(45) Date of Patent: Jan. 19, 2016

(54) ORGANIC ELECTROLUMINESCENT DISPLAY DEVICE AND METHOD OF DRIVING THE SAME

(75) Inventors: Hak-Su Kim, Seoul (KR); Sang-Ho Yu, Gumi-si (KR); Won-Kyu Ha, Gumi-si (KR)

(73) Assignee: LG Display Co., Ltd., Seoul (KR)

( * ) Notice: Subject to any disclaimer, the term of this patent is extended or adjusted under 35 U.S.C. 154(b) by 876 days.

(21) Appl. No.: 12/591,310

(22) Filed: Nov. 16, 2009

(65) Prior Publication Data

US 2010/0156875 A1 Jun. 24, 2010

(30) Foreign Application Priority Data

Dec. 24, 2008 (KR) ..... 10-2008-0133754

(51) Int. Cl.

| | |
|---|---|
| ***G09G 5/00*** | (2006.01) |
| ***G09G 3/30*** | (2006.01) |
| ***G09G 3/32*** | (2006.01) |

(52) U.S. Cl.

CPC ..... *G09G 3/3233* (2013.01); *G09G 2300/0819* (2013.01); *G09G 2300/0842* (2013.01); *G09G 2310/0224* (2013.01); *G09G 2310/0251* (2013.01); *G09G 2320/0233* (2013.01); *G09G 2320/0252* (2013.01); *G09G 2320/043* (2013.01)

(58) Field of Classification Search

USPC ..... 345/76–83

See application file for complete search history.

(56) References Cited

U.S. PATENT DOCUMENTS

| | | | | |
|---|---|---|---|---|
| 2003/0112205 | A1* | 6/2003 | Yamada | 345/32 |
| 2004/0196223 | A1* | 10/2004 | Kwon | 345/82 |
| 2005/0007319 | A1* | 1/2005 | Shin et al. | 345/76 |
| 2005/0200575 | A1* | 9/2005 | Kim et al. | 345/76 |
| 2005/0280614 | A1* | 12/2005 | Goh | G09G 3/3233 345/76 |
| 2006/0038762 | A1* | 2/2006 | Chou | G09G 3/325 345/92 |
| 2006/0066527 | A1* | 3/2006 | Chou | G09G 3/3241 345/76 |

(Continued)

FOREIGN PATENT DOCUMENTS

| | | |
|---|---|---|
| CN | 1892773 A | 1/2007 |
| CN | 101093639 | 12/2007 |

(Continued)

OTHER PUBLICATIONS

Machine translatuon of KR10-2007-0003575.*

*Primary Examiner* — Seokyun Moon
*Assistant Examiner* — Josemarie G Acha, III
(74) *Attorney, Agent, or Firm* — Dentons US LLP

(57) ABSTRACT

An organic electroluminescent display device includes a plurality of pixels, each one of the plurality of pixels including: a switching transistor that is connected to a gate line and a data line; a driving transistor, wherein a data voltage of the data line passing through the switching transistor is reflected into a gate of the driving transistor; a sampling transistor that samples a threshold voltage of the driving transistor, wherein a gate of the sampling transistor is connected to a control line, and the sampled threshold voltage is reflected into the gate of the driving transistor; an initializing transistor, wherein a gate of the initializing transistor is connected to a previous or next gate line, and an initialization voltage passing through the initializing transistor is reflected into the gate of the driving transistor; and an organic light emitting diode that is connected to the driving transistor, wherein a driving current of the organic light emitting diode is adjusted according to a voltage of the gate of the driving transistor.

12 Claims, 6 Drawing Sheets

(56) References Cited

U.S. PATENT DOCUMENTS

2006/0077134 A1* 4/2006 Hector ..... G09G 3/3233 345/76
2006/0231740 A1* 10/2006 Kasai ..... G09G 3/3233 250/214.1
2006/0244688 A1* 11/2006 Ahn et al. ..... 345/76
2006/0290614 A1* 12/2006 Nathan ..... G09G 3/3233 345/76
2007/0024547 A1* 2/2007 Jang ..... G09G 3/3233 345/81
2007/0268217 A1* 11/2007 Ahn ..... G09G 3/325 345/76
2007/0273620 A1* 11/2007 Yumoto ..... G09G 3/3233 345/76
2007/0296671 A1* 12/2007 Han ..... G09G 3/3233 345/92
2008/0088549 A1* 4/2008 Nathan et al. ..... 345/80
2008/0211746 A1* 9/2008 Caligiore et al. ..... 345/76

FOREIGN PATENT DOCUMENTS

CN 101228569 A 7/2008
CN 101231821 A 7/2008
KR 10-2007-0003575 * 1/2007 ..... G09G 3/30

* cited by examiner

ORGANIC ELECTROLUMINESCENT DISPLAY DEVICE AND METHOD OF DRIVING THE SAME

The present invention claims the benefit of Korean Patent Application No. 2008-0133754, filed in Korea on Dec. 24, 2008, which is hereby incorporated by reference for all purposes as if fully set forth herein.

BACKGROUND OF THE INVENTION

1. Field of the Invention

The present invention relates to an organic electroluminescent display device, and more particularly, to an organic electroluminescent display (OELD) device and a method of driving the same.

2. Discussion of the Related Art

Until recently, display devices have typically used cathode-ray tubes (CRTs). Presently, many efforts and studies are being made to develop various types of flat panel displays, such as liquid crystal display (LCD) devices, plasma display panels (PDPs), field emission displays, and electro-luminescence displays (ELDs), as a substitute for CRTs. Of these flat panel displays, organic electroluminescent display (OELD) devices are self-luminescent display devices. The OELD devices operate at low voltages and have a thin profile. Further, the OELD devices have fast response time, high brightness, and wide viewing angles.

FIG. 1 is a circuit diagram illustrating an OELD device according to the related art, and FIG. 2 is a circuit diagram illustrating another OELD device according to the related art.

Referring to FIGS. 1 and 2, a pixel of the OELD device of FIG. 1 includes first to fourth transistors Tr1 to Tr4 and a capacitor C1. A pixel of the OELD device of FIG. 2 includes first to fourth transistors Tr1 to Tr4, and first and second capacitors C1 and C2. For convenience' sake, the OELD devices of FIGS. 1 and 2 are referred to as first and second OELD devices, respectively.

In each of the first and second OELD devices, the first transistor Tr1 is switched by a gate voltage Vg1 or Vg2 applied to a gate line to write a data voltage Vdata to the pixel in each frame. The second transistor Tr2 functions to sample a threshold voltage Vth of the third transistor Tr3. The third transistor Tr3 functions to supply a driving current $I_{OLED}$ to an organic light emitting diode OLED. The fourth transistor Tr4 functions to supply an initialization voltage Vinit to the pixel.

The configuration of the pixel of each of the first and second OELD devices is provided to cope with a variation of the threshold voltage of the third transistor Tr3 due to a variation of a property of the third transistor Tr3 in operation and/or due to a variation of a manufacturing process.

A first driving voltage Vdd_EL is connected to the organic light emitting diode OLED, and a second driving voltage Vss_EL is connected to the third transistor Tr3.

A method of driving the first and second OELD devices is explained with reference to FIGS. 1 to 3.

FIG. 3 is a timing chart of gate voltages and control voltages to drive the OELD devices according to the related art.

Referring to FIGS. 1 to 3, the fourth transistor Tr4 is turned on per frame F according to an initialization control voltage Init1, Init2, Init3, or Init4, and the initialization voltage Vinit is applied to the gate of the third transistor Tr3. Then, the second transistor Tr2 is turned on according to a control voltage Con1, Con2, Con3, or Con4, and the threshold voltage Vth of the third transistor Tr3 is sampled to the gate of the third transistor Tr3. Then, the first transistor Tr1 is turned on according to the gate voltage Vg1, Vg2, Vg3, or Vg4, and a data voltage Vdata is written into the pixel. The third transistor Tr3 adjusts the driving current $I_{OLED}$, which flows through the third transistor Tr3, according to an amount of the data voltage Vdata. Accordingly, the driving current $I_{OLED}$ is supplied to the organic light emitting diode OLED, and light is emitted from the organic light emitting diode OLED according to an amount of the driving current $I_{OLED}$.

The driving current $I_{OLED}$ is expressed as a following formula, $I_{OLED}=\frac{1}{2}*\mu*C_{OX}*(W/L)*(Vgs-Vth)^2$. In the formula, μ is a mobility of the third transistor Tr3, $C_{OX}$ is a capacitance of the third transistor Tr3, W/L is a ratio of width to length of a channel of the third transistor Tr3, and Vgs is a gate-source voltage between the gate and source of the third transistor Tr3.

The sampled threshold voltage Vth by the sampling operation of the second transistor Tr2 is reflected into the formula, for example, into the gate-source voltage Vgs. Accordingly, the driving current $I_{OLED}$ does not depend on the threshold voltage Vth of the third transistor Tr3. Therefore, the organic light emitting diode OLED emits light irrespectively of the variation of the threshold voltage Vth of the third transistor Tr3. This type of driving method is referred to as a voltage compensation driving method.

However, the voltage compensation driving needs a predetermined time in driving each row line. For example, an initializing period for the initializing operation needs about 3 microseconds (μs), a sampling period for the sampling operation needs about 8 microseconds (μs), and a data writing period for the data writing operation needs about 4 microseconds (μs). A sum of the initializing period, the sampling period and the data writing period is about 15 microseconds (μs). Accordingly, a row line drive period for the voltage compensation driving needs at least about 15 microseconds (μs).

However, when the related art OELD devices have a Full HD (High Definition) resolution, for example, 1900*1080 resolution, and is driven with a frequency of 120 Hertz (Hz), a row line drive period is about $(1/120)*(1/1080)=7.7$ microseconds (μs). Accordingly, the row line drive period of the related art OELD devices is much less than the row line drive period required for the voltage compensation driving. Accordingly, the related art OELD devices can not normally perform the voltage compensation driving.

As described, since the short row line drive period is allotted in driving the related art OELD devices, there are many limits to displaying images.

SUMMARY OF THE INVENTION

Accordingly, the present invention is directed to an organic electroluminescent display device and a method of driving the same that substantially obviates one or more of the problems due to limitations and disadvantages of the related art.

An advantage of the present invention is to provide an organic electroluminescent display device and a method of driving the same that can provide a row line drive time enough to normally display images.

Additional features and advantages of the present invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described herein, an organic electroluminescent display device includes a plurality of pixels, one of the plurality of pixel including: a switching transistor that is connected to a gate line and a data line; a driving transistor, wherein a data voltage of the data line passing through the switching transistor is reflected into a gate of the driving transistor; a sampling transistor that samples a threshold voltage of the driving transistor, wherein a gate of the sampling transistor is connected to a control line, and the sampled threshold voltage is reflected into the gate of the driving transistor; an initializing transistor, wherein a gate of the initializing transistor is connected to a previous or next gate line, and an initialization voltage passing through the initializing transistor is reflected into the gate of the driving transistor; and an organic light emitting diode that is connected to the driving transistor, wherein a driving current of the organic light emitting diode is adjusted according to a voltage of the gate of the driving transistor.

In another aspect, a method of driving an organic electroluminescent display device includes initializing a first pixel of a plurality of pixels with an initializing voltage in a first frame; writing a first data voltage into a second pixel of the plurality of pixels in the first frame, whereby the second pixel emits light according to the first data voltage; writing a second data voltage into the first pixel in a second frame, whereby the first pixel emits light according to the second data voltage; and initializing the second pixel with the initializing voltage in the second frame, wherein the first and second frames are alternatingly repeated, wherein the first and second pixels are connected to consecutive two gate lines, respectively, wherein each of the plurality of pixels includes a driving transistor and an organic light emitting diode, wherein the driving transistor adjusts a current applied to the organic light emitting diode according to a voltage of a gate of the driving transistor.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to illustrated embodiments of the present invention, which are illustrated in the accompanying drawings.

Figure 4:
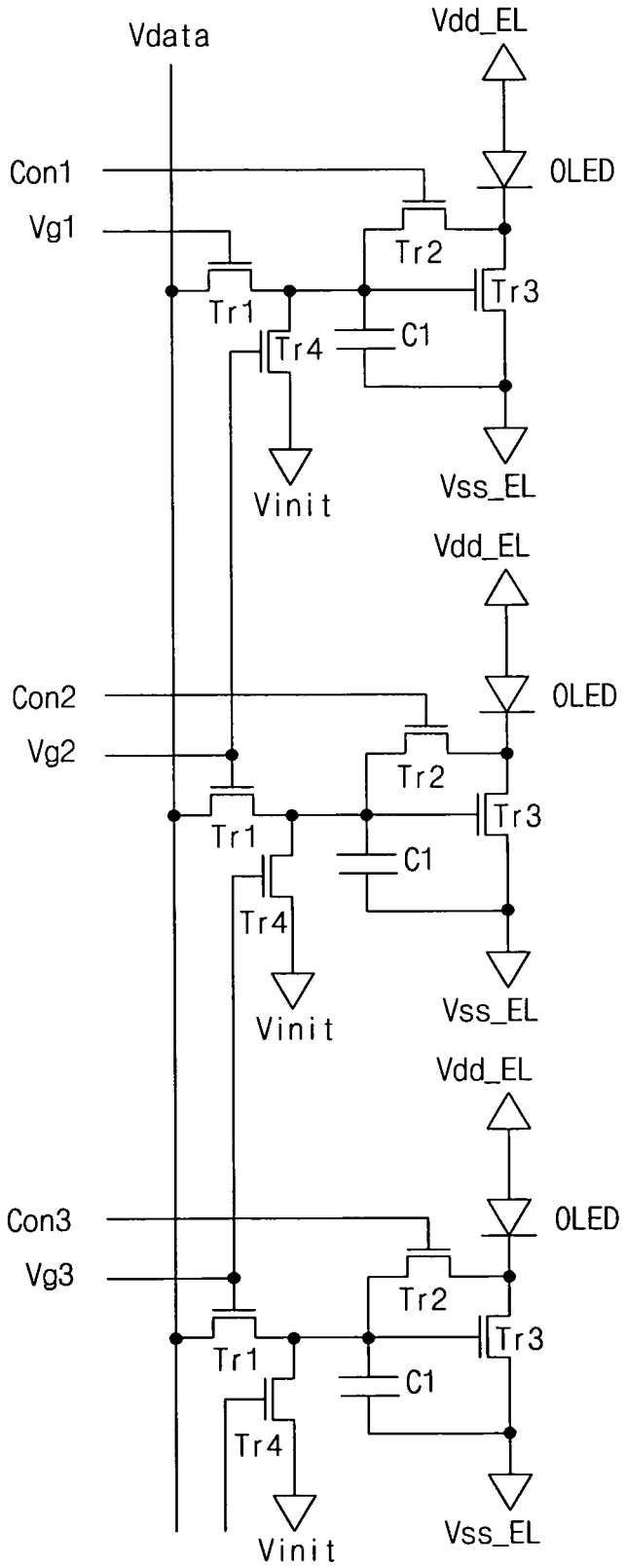
FIG. 4 is a circuit diagram illustrating an OELD device according to an embodiment of the present invention.
Figure 5:
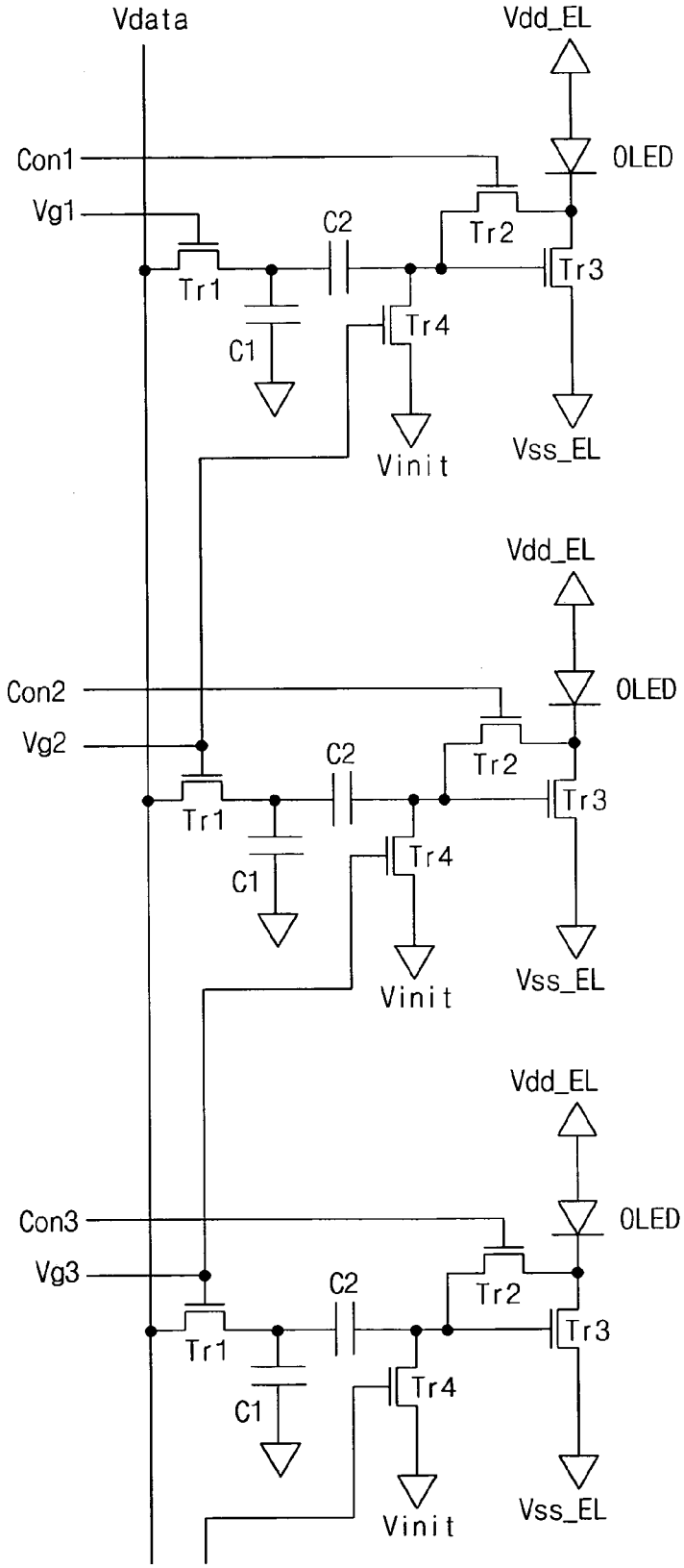
FIG. 5 is a circuit diagram illustrating another OELD device according to the embodiment of the present invention.

FIG. 4 is a circuit diagram illustrating an OELD device according to an embodiment of the present invention, and FIG. 5 is a circuit diagram illustrating another OELD device according to the embodiment of the present invention.

Figure 1:
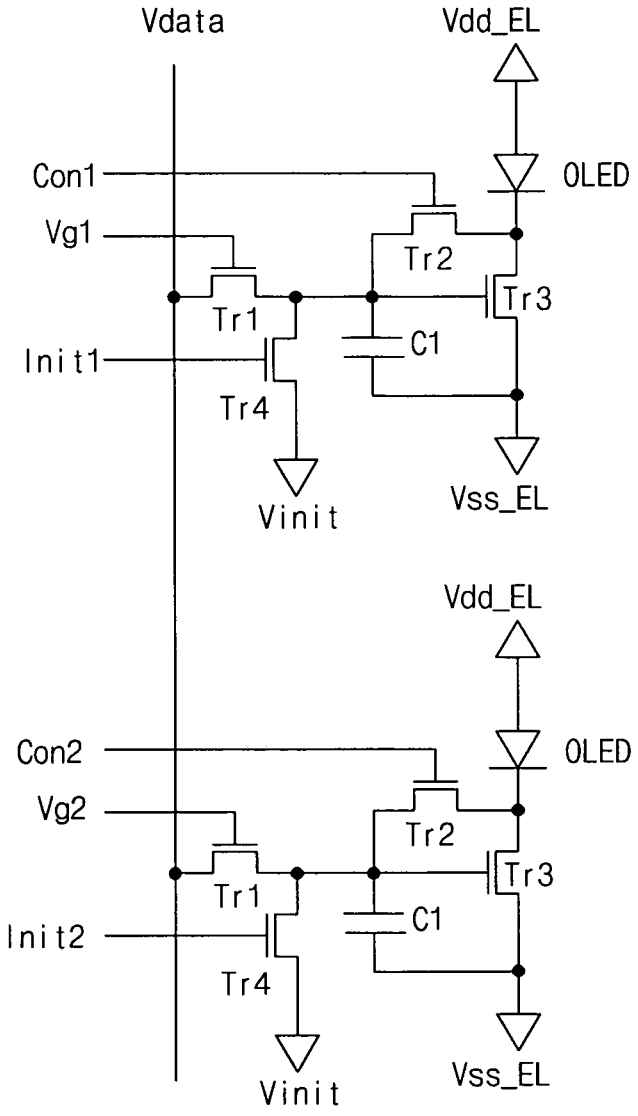
FIG. 1 RELATED ART
FIG. 1 is a circuit diagram illustrating an OELD device according to the related art.
Figure 2:
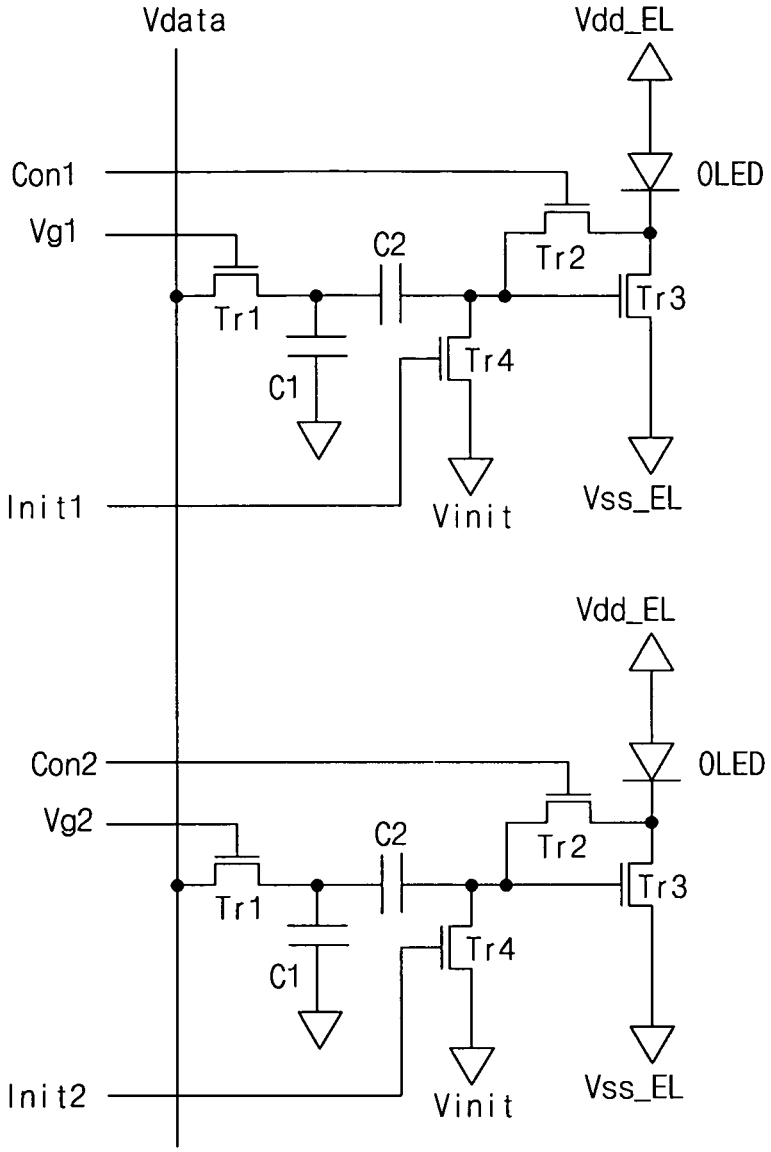
FIG. 2 RELATED ART
FIG. 2 is a circuit diagram illustrating another OELD device according to the related art.
Figure 3:
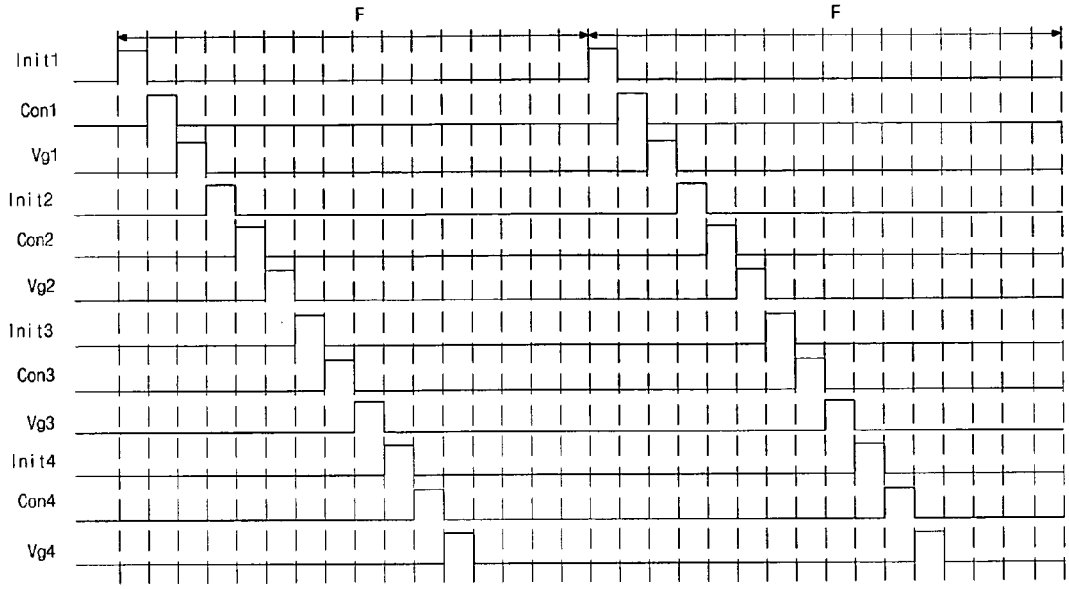
FIG. 3 RELATED ART
FIG. 3 is a timing chart of gate voltages and control voltages to drive the OELD devices according to the related art.

Referring to FIG. 4, the OELD device includes a plurality of pixels in a matrix form, and the pixel includes first to fourth transistors Tr1 to Tr4, a capacitor C1 and an organic light emitting diode OLED. Referring to FIG. 5, the OELD device includes a plurality of pixels in a matrix form, and the pixel includes first to fourth transistors Tr1 to Tr4, first and second capacitors C1 and C2, and an organic light emitting diode OLED. For convenience' sake, the OELD devices of FIGS. 1 and 2 are referred to as first and second OELD devices, respectively. Further, explanations of the first and second OELD devices may be made together.

In each of the first and second OELD devices, a data line transferring a data voltage Vdata and first to third gate lines transferring gate voltages Vg1 to Vg3, respectively, and first to third control lines transferring control voltages Con1 to Con3 are formed. The data line crosses the gate lines. A first driving voltage Vdd_EL is connected to the organic light emitting diode OLED, and a second driving voltage Vss_EL is connected to the third transistor Tr3. The first driving voltage Vdd_EL may be higher than the second driving voltage Vss_EL.

The first transistor Tr1 is referred to as a switching transistor. The first transistor Tr1 is connected to the corresponding gate and data lines. The first transistor Tr1 is turned on/off according to on/off levels of the corresponding gate voltage Vg1, Vg2 or Vg3. When the first transistor Tr1 is turned on, the data voltage Vdata passes through the first transistor Tr1 and is written into the pixel.

The second transistor Tr2 is referred to as a sampling transistor. The second transistor Tr2 functions to sample a threshold voltage Vth of the third transistor Tr3. The second transistor Tr2 is turned on/off according to on/off levels of the corresponding control voltages Con1, Con2 or Con3. When the second transistor Tr2 is turned on, the threshold voltage Vth of the third transistor Tr3 is sampled through the second transistor Tr2.

The third transistor Tr3 is referred to as a driving transistor. The third transistor Tr3 functions to supply a driving current $I_{OLED}$ to an organic light emitting diode OLED. The third transistor Tr3 adjusts the driving current $I_{OLED}$ according to the written data voltage Vdata.

The fourth transistor Tr4 is referred to as an initializing transistor. The fourth transistor Tr4 functions to initialize the pixel with an initialization voltage Vinit. The fourth transistor Tr4 is turned on/off according to on/off levels of the gate voltage of the next gate line. Alternatively, the fourth transistor Tr4 may be turned on/off according to on/off levels of the gate voltage of the previous gate line. When the fourth transistor Tr4 is turned on, the initialization voltage Vinit is applied to the pixel, for example, the gate of the third transistor Tr3 so that a voltage of the gate of the third transistor Tr3 is initialized with the initialization voltage Vinit.

In each of the first and second OELD devices, the pixels at odd row lines may be driven during a frame while the pixels at even row lines may be driven during a next frame. For example, first and second frames are alternated, the pixels at the odd row lines may be driven during the first frame while the pixels at the even row lines may not be driven during the first frame. The pixels at the even row lines may be driven during the second frame while the pixels at the odd row lines may not be driven during the second frame. Further, during the frame when the pixels are not driven, such the not-driven pixels may be initialized with the initialization voltage Vinit according to the gate voltage of the previous or next gate line.

For example, in the first frame, the pixel at the odd row line is driven and the corresponding data voltage Vdata is written into the pixel at the odd row line. However, in the first frame, the pixel at the even row line is not driven, no data voltage Vdata is not written into the pixel at the even row line, and the initialization voltage Vinit is written into the pixel at the even row line according to the gate voltage of the previous or next gate line i.e., the gate line at the odd row line.

When the pixel is applied with the initialization voltage Vinit, the pixel does not emit light. For example, in the first frame, the pixel at the even row line is initialized with the initialization voltage Vinit, the third transistor Tr3 of the pixel at the even row line is turned off, the driving current $I_{OLED}$ does not flow through the driving transistor Tr3, and thus, the organic light emitting diode OLED does not emit light. The initialization voltage Vinit has a value such that the third transistor Tr3 is turned off. For example, the initialization voltage Vinit may be lower than the second driving voltage Vss_EL.

As not shown in the drawings, each of the first and second OELD devices may include a data driving circuit supplying the data voltage Vdata, a gate driving circuit supplying the gate voltages Vg1 to Vg3, and a control circuit supplying the control voltages Con1 to Con3. The gate driving circuit may function as the control circuit to supply the control voltages Con1 to Con3 from the gate driving circuit.

In the first OELD device, the capacitor C1 may be connected to the gate and source of the third driving transistor Tr3. In the second OELD device, the first capacitor C1 may be connected to a drain of the first transistor Tr1 and a driving voltage source, and the second capacitor C2 may be connected to the drain of the first transistor Tr1 and the gate of the third transistor Tr3. The driving voltage source connected to the first capacitor C1 may supply the second driving voltage Vss_EL.

A method of driving the first and second OELD devices is explained in detail with reference to FIGS. 4 to 6.

Figure 6:
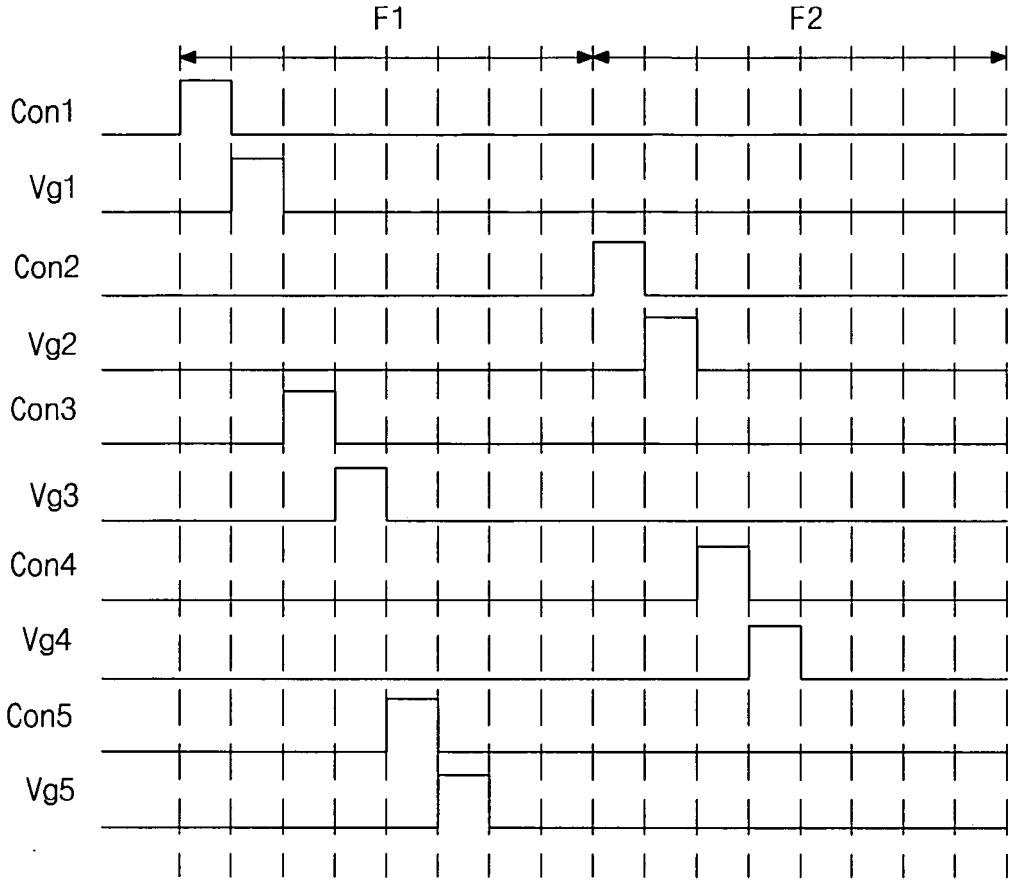
FIG. 6 is a timing chart of gate voltages and control voltages to drive the OELD devices according to the embodiment of the present invention.

FIG. 6 is a timing chart of gate voltages and control voltages to drive the OELD devices according to the embodiment of the present invention.

Referring to FIGS. 4 to 6, during the first frame F1, for example, the pixels at the odd row lines are driven while the pixels at the even row lines are not driven. Accordingly, gate voltages Vg1, Vg3 and Vg5 having an on level may be sequentially outputted to corresponding odd gate lines, and control voltages Con1, Con3 and Con5 having an on level may be sequentially outputted to corresponding odd control lines. When the on-level control voltage Con1, Con3 or Con5 is applied, the second transistor Tr2 of the pixel is turned on, and the threshold voltage Vth of the third transistor Tr3 is sampled to the gate of the third transistor Tr3. Then, when the on-level gate voltage Vg1, Vg3 or Vg5 is applied, the data voltage Vdata is written into the pixel. Accordingly, the third transistor Tr3 is turned off. Accordingly, the pixels at the odd row lines emit light.

The pixels at the even row lines are initialized during the first frame F1 so that previously written data voltages of the pixels at the even row lines are deleted. For example, the gate voltage Vg3 or Vg5 is applied to the fourth transistor Tr4 of the pixel at the even row line which is prior to the odd row line for the gate voltage Vg3 or Vg5. Accordingly, the fourth transistor Tr4 of the pixel at the even row line is turned on, and the initialization voltage Vinit is applied to the gate of the third transistor Tr3 of the pixel at the even row line. Accordingly, the pixels at the even row lines do not emit light.

During the second frame F2, for example, the pixels at the even row lines are driven while the pixels at the odd row lines are not driven. Accordingly, on-level gate voltages Vg2 and Vg4 may be sequentially outputted to corresponding even gate lines, and on-level control voltages Vc2 and Vc4 may be sequentially outputted to corresponding even control lines. When the on-level control voltage Vc2 or Vc4 is applied, the second transistor Tr2 of the pixel is turned on, and the threshold voltage Vth of the third transistor Tr3 is sampled to the gate of the third transistor Tr3. Then, when the on-level gate voltage Vg2 or Vg4 is applied, the data voltage Vdata is written into the pixel. Accordingly, the pixels at the even row lines emit light.

The pixels at the odd row lines are initialized during the second frame F2 so that previously written data voltages of the pixels at the odd row lines are deleted. For example, the gate voltage Vg2 or Vg4 are applied to the fourth transistors Tr4 of the pixel at the odd row line which is prior to the even row line for the gate voltage Vg2 or Vg4. Accordingly, the fourth transistor Tr4 of the pixel at the odd row line is turned on, and the initialization voltage Vinit is applied to the gate of the third transistor Tr3 of the pixel at the odd row line. Accordingly, the third transistor Tr3 is turned off. Accordingly, the pixels at the odd row lines do not emit light.

The processes as above are repeated during subsequent alternating first and second frames F1 and F2.

As described above, since the pixels at the odd row lines and the pixels at the even row lines are alternatingly driven by frame, each row line drive period of the OELD devices can be reduced. For example, when each of the first and second OELD devices has a Full HD (1900*1080) resolution and is driven with a frequency of 120 Hertz (Hz), each row line drive period is about $(1/120)*(1/540)=15.4$ microseconds (μs). This row line drive period is longer than a required time, for a voltage compensation driving, of about 15 microseconds (μs) i.e., a sum of an initializing period of about 3 microseconds (μs), a sampling period of about 8 microseconds (μs) and a data writing period of about 4 microseconds (μs). Accordingly, the OELD devices of the embodiment can be stably driven in a voltage compensation driving method, and images can be normally displayed.

In addition, the data, which was written into the pixel in a previous frame, is deleted in an instant frame by the initialization operation. If the previously written data image still remains in the instant frame, the instant frame image is perceived to be torn. This frame image tearing can be prevented by initializing the pixel to delete the previously written data from the pixel.

In addition, in the related art, the initialization control lines for the initializing operation are required. However, in the OELD devices of the embodiment, the initializing operation is performed according to the previous or next gate voltage. Accordingly, the initialization control lines and a driving circuit portion for the initialization control lines need not be equipped. Accordingly, manufacturing processes and costs can be reduced.

In the embodiments, the OELD devices including negative type transistors are mainly explained. Alternatively, the OELD devices may include positive type transistors or combination of negative type transistors and positive type transistors.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. An organic electroluminescent display device, comprising:

a plurality of pixels, each one of the plurality of pixels including:

a switching transistor connected to a gate line and a data line;

a driving transistor, wherein a data voltage of the data line passing through the switching transistor is reflected into a gate of the driving transistor;

a sampling transistor that samples a threshold voltage of the driving transistor, wherein a gate of the sampling transistor is connected to a control line, and the sampled threshold voltage is reflected into the gate of the driving transistor;

an initializing transistor, wherein a gate of the initializing transistor is connected to a next gate line, and an initialization voltage, which is different from the threshold voltage, passing through the initializing transistor is reflected into the gate of the driving transistor, wherein the voltage at the gate of the driving transistor is equivalent to the initialization voltage when the initializing transistor is turned on, and wherein the initialization voltage applied to the gate of the driving transistor is lower than a second driving voltage; and an organic light emitting diode that is connected to the driving transistor, wherein a driving current of the organic light emitting diode is adjusted according to a voltage of the gate of the driving transistor, wherein a first pixel of the plurality of pixels maintains an initialized state and does not emit light during a first frame, and a second pixel of the plurality of pixels maintains an initialized state and does not emit light during a second frame that alternates with the first frame, wherein, during the first frame, a sampling transistor of a third pixel of the plurality of pixels is not enabled when an initializing transistor of the first pixel of the plurality of pixels is enabled, and wherein, during the second frame, a sampling transistor of a fourth pixel of the plurality of pixels is not enabled when an initializing transistor of the second pixel of the plurality of pixel is enabled.

2. The device according to claim 1, wherein at least one of the switching transistor, the driving transistor, the sampling transistor, and the initializing transistor is a n-type or p-type transistor.

3. The device according to claim 1, wherein the initialization voltage has a value such that the organic light emitting diode does not emit light.

4. The device according to claim 3, wherein, in the first and the second frames, a control voltage of the control line is transitioned high prior to a gate voltage of the gate line.

5. The device according to claim 1, wherein the each one of the plurality of pixels further includes a capacitor connected to the gate and a source of the driving transistor.

6. The device according to claim 1, wherein the each one of the plurality of pixels further includes a first capacitor connected to a drain of the switching transistor and a driving voltage source, and a second capacitor connected to the drain of the switching transistor and the gate of the driving transistor.

7. A method of driving an organic electroluminescent display device, comprising:

initializing a first pixel of a plurality of pixels with an initializing voltage without simultaneously sampling a third threshold voltage of a driving transistor of a third pixel in a first frame;

writing a first data voltage into a second pixel of the plurality of pixels in the first frame, whereby the second pixel emits light according to the first data voltage;

writing a second data voltage into the first pixel in a second frame, whereby the first pixel emits light according to the second data voltage; and initializing the second pixel with the initializing voltage without simultaneously sampling a fourth threshold voltage of a driving transistor of a fourth pixel in the second frame, wherein the first and the second frames are alternatingly repeated, wherein the first and the second pixels are connected to two consecutive gate lines, respectively, wherein each of the plurality of pixels includes a driving transistor and an organic light emitting diode, wherein the driving transistor adjusts a current applied to the organic light emitting diode according to a voltage of a gate of the driving transistor, wherein the first pixel maintains the initialized state and does not emit light during the first frame, and the second pixel maintains the initialized state and does not emit light during the second frame, and wherein each of the plurality of pixels includes an initializing transistor for initialization thereof with the initializing voltage which is different from a threshold voltage of the driving transistor, wherein a gate of the initializing transistor is connected to a next gate line and the voltage at the gate of the driving transistor is equivalent to the initialization voltage when the initializing transistor is turned on, and wherein the initialization voltage applied to the gate of the driving transistor is lower than a second driving voltage.

8. The method according to claim 7, further comprising:

sampling a first threshold voltage of the driving transistor of the first pixel in the second frame before writing the second data voltage into the first pixel, wherein the sampled first threshold voltage is reflected into the gate of the driving transistor of the first pixel; and sampling a second threshold voltage of the driving transistor of the second pixel in the first frame before writing the first data voltage into the second pixel, wherein the sampled second threshold voltage is reflected into the gate of the driving transistor of the second pixel.

9. The method according to claim 7, wherein initializing the first pixel with the initialization voltage includes turning on an initializing transistor of the first pixel according to an on-level gate voltage of a gate line next to the gate line connected to the first pixel, and wherein initializing the second pixel with the initialization voltage includes turning on an initializing transistor of the second pixel according to an on-level gate voltage of a gate line next to the gate line connected to the second pixel.

10. The method according to claim 7, wherein the driving transistor of each of the first and the second pixels is turned off according to the initialization voltage.

11. The method according to claim 7, wherein each of the plurality of pixels further includes a capacitor connected to the gate and a source of the driving transistor.

12. The method according to claim 7, wherein each of the plurality of pixels further includes a switching transistor, a first capacitor connected to a drain of the switching transistor and a driving voltage source, and a second capacitor connected to the drain of the switching transistor and the gate of the driving transistor.

* * * * *